US007214034B2

(12) United States Patent
Giot et al.

(10) Patent No.: US 7,214,034 B2
(45) Date of Patent: May 8, 2007

(54) CONTROL OF LEAK ZONE UNDER BLADE PLATFORM

(75) Inventors: Chantal Giot, Combs la Ville (FR); Marc Marchi, Le Mee sur Seine (FR); Christian Gosselin, Vert Saint Denis (FR); Eric Bil, Chartrettes (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/514,559

(22) PCT Filed: May 28, 2003

(86) PCT No.: PCT/FR03/01611

§ 371 (c)(1),
(2), (4) Date: Nov. 30, 2004

(87) PCT Pub. No.: WO03/102380

PCT Pub. Date: Dec. 11, 2003

(65) Prior Publication Data

US 2005/0175463 A1 Aug. 11, 2005

(30) Foreign Application Priority Data

May 30, 2002 (FR) ..... 02 06599

(51) Int. Cl.
*F01D 11/00* (2006.01)

(52) U.S. Cl. ..... 416/193 A

(58) Field of Classification Search ..... 416/193 A
See application file for complete search history.

(56) References Cited

U.S. PATENT DOCUMENTS 2,999,631 A 9/1961 Wollmershauser ..... 416/191
4,457,668 A * 7/1984 Hallinger ..... 416/95
4,505,642 A 3/1985 Hill ..... 416/193 A
4,872,810 A * 10/1989 Brown et al. ..... 416/145
5,228,835 A 7/1993 Chlus ..... 416/193 A
5,281,097 A * 1/1994 Wilson et al. ..... 416/193 A
5,460,489 A 10/1995 Benjamin et al. ..... 416/248
5,573,375 A * 11/1996 Barcza ..... 416/193 A
5,577,887 A 11/1996 Gouyon et al. ..... 415/174.2
5,924,699 A * 7/1999 Airey et al. ..... 277/411

FOREIGN PATENT DOCUMENTS

EP 0 816 638 1/1998
EP 0 851 096 7/1998

* cited by examiner

*Primary Examiner*—Edward K. Look
*Assistant Examiner*—Nathan Wiehe
(74) *Attorney, Agent, or Firm*—Oblon, Spivak, McClelland, Maier & Neustadt, P.C.

(57) ABSTRACT

A system for controlling a leakage zone under platforms of blades of a turbomachine blade-wheel by liners having edges that flare radially inwards, and that are disposed in inter-blade cavities defined by the platforms, by upstream and downstream radial walls of the blades and by the periphery of the wheel disk. One of the flared edges, upstream or downstream, presents an elastic zone bearing on an inclined surface of the adjacent radial wall relative to a radial plane, such that the liner tends to move axially towards the radial wall facing, under action of centrifugal forces, to improve sealing in the zone, and so that when the wheel stops, the elastic zone moves radially inwards, the liner pivoting around an axis distant from the elastic zone.

14 Claims, 4 Drawing Sheets

CONTROL OF LEAK ZONE UNDER BLADE PLATFORM

The invention relates to controlling the leakage zones under the platforms of the blades of a blade-wheel in a turbomachine.

More precisely, the invention relates to a turbomachine blade-wheel comprising a disk presenting a plurality of substantially axial slots on its periphery, a plurality of blades having roots that are retained in said slots, and which blades present platforms for defining the stream of gas on the radially inner side, and upstream and downstream radial walls which extend from said platforms towards the periphery of said disk, inter-blade cavities defined by said platforms and the periphery of said disk, and sealing devices for sealing the inter-blade spaces, the sealing devices being made in the form of liners having edges that flare radially inwards and that are disposed in said cavities against the walls of the platforms of two adjacent blades.

FIG. 1 is a perspective view showing a sealing liner 1 of the prior art which presents an upstream edge 2 and a downstream edge 3 that flare radially inwards, and also two curved longitudinal flaring edges which fit closely against the flanks of the blades under the platforms. The upstream and downstream edges 2 and 3 are designed to come into the immediate vicinity of the adjacent upstream and downstream radial walls of two adjacent blades, in order to limit leakage through the space separating the adjacent lateral walls. The top wall 6 of each liner bears against the bottom faces of two adjacent platforms under the action of centrifugal forces when the wheel is rotating and seals the gap between the adjacent platforms. By construction, it is practically impossible for the flared edges to be deformed under the action of centrifugal forces, and it is impossible to ensure that the upstream and downstream flared edges (2 and 3) are pressed effectively against the upstream and downstream radial walls of the blades. As shown in FIG. 2, those edges may be spaced apart from the adjacent radial walls, which results in an air leak f between the cavity under the platform and the stream of gas in these zones, which is prejudicial to the efficiency of the wheel.

The object of the invention is to have better control over the leakage zone under a blade platform, particularly in the gaps between the under-platform radial walls.

The invention achieves this object by the fact that each liner presents an elastic zone on one of its upstream and downstream flared edges, and the radial walls adjacent to said edges are connected to the platforms by inside surfaces that are inclined relative to a radial plane, and against which edges said elastic zone bears, in such a manner that said elastic zone can slide radially inwards in the event of said wheel ceasing to rotate, and radially outwards under the action of centrifugal forces in order to urge said liner to move axially towards the radial walls distant from said elastic zone so as to improve sealing in said zone.

In the event of the blade-wheel ceasing to turn, the elastic zone slides radially inwards and the liner relaxes, moving itself away from the bottom walls of the two platforms, at least in the regions adjacent to the elastic zone. When the blade-wheel starts to rotate, the centrifugal forces press the liner against the bottom walls of the platforms, and the elastic forces push the corresponding flared edge towards the lateral walls facing the elastic edge, in order to improve sealing in this location. Since the elastic zones are still bearing against the adjacent lateral walls, sealing in this zone is guaranteed.

Advantageously, the radial walls that are spaced apart from the elastic zones include abutments to limit the axial movement of the liners under the action of centrifugal forces.

The lateral walls that are adjacent to the elastic zones also include abutments to limit inward sliding of said elastic zones.

According to an advantageous characteristic of the invention, the elastic zones are circumferentially defined by two notches that are cut in the corresponding flared edges of the liners. This disposition facilitates implementation of the invention at no additional cost.

The invention applies particularly to turbine blade-wheels.

In this specific example, the elastic zone is provided on the upstream edge, and the angle of the surface that is inclined relative to the radial plane is greater than the slope of the platform relative to the axis of rotation of the turbomachine.

Other characteristics and advantages of the invention appear on reading the following description, given by way of example and with reference to the accompanying figures, in which:

FIGS. 1 and 2 show the prior art which is described above in the present document.

Figure 3:
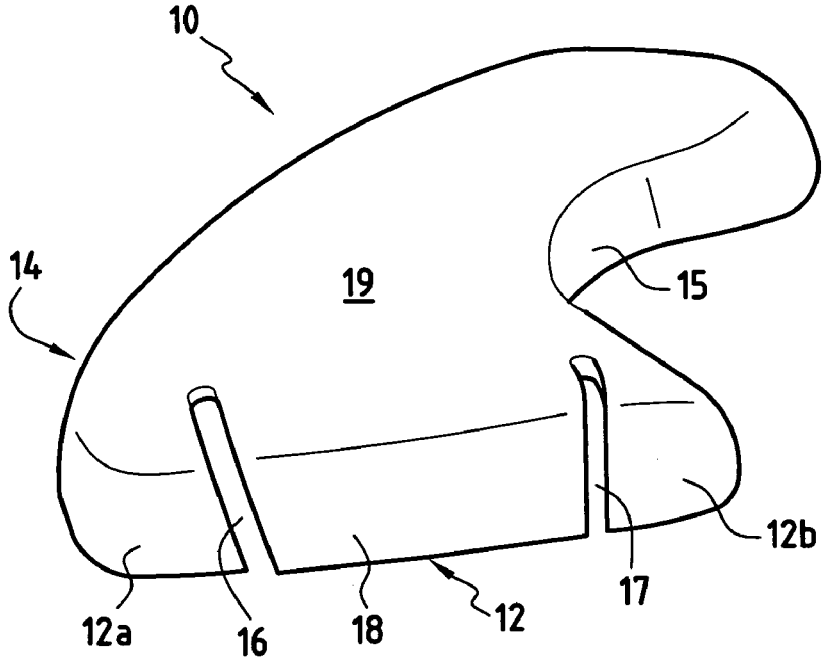
FIG. 3 is a view from above and in perspective of a sealing liner of the invention.
Figure 4:
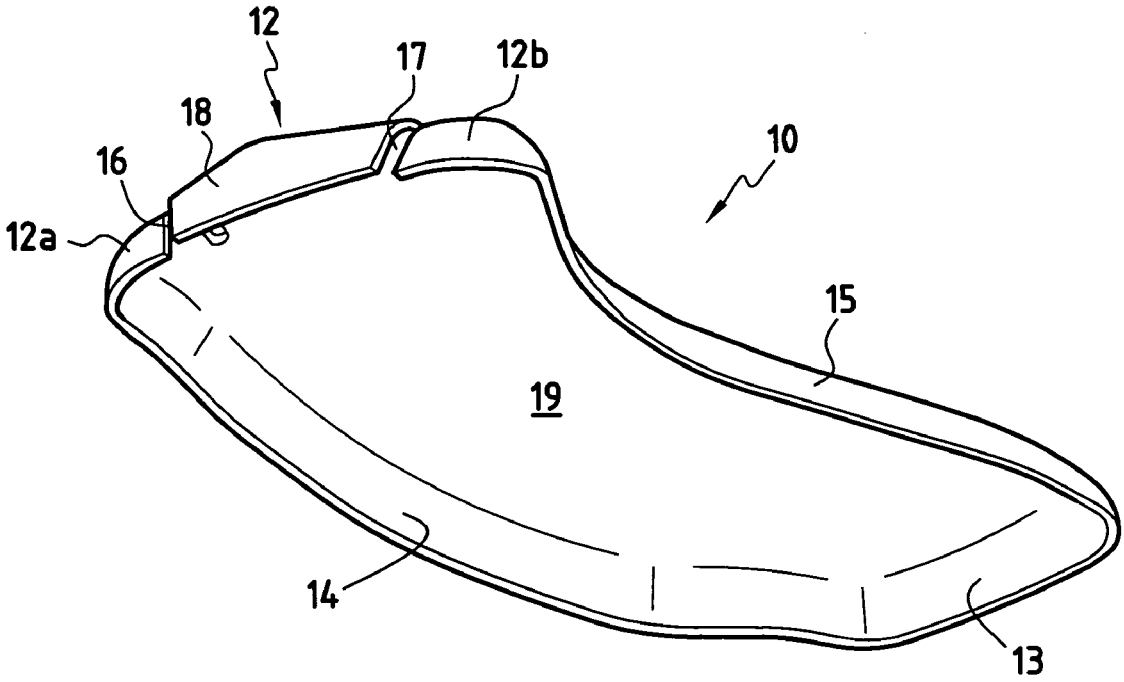
FIG. 4 is a view from below and in perspective of the sealing liner in FIG. 3.

FIGS. 3 and 4 show a sealing liner 10 of the invention which has edges that flare radially inwards, that is, an upstream edge 12, a downstream edge 13, and between the upstream edge 12 and the downstream edge 13 two longitudinal inwardly curved flaring edges which fit closely to the shape of the flanks of two adjacent blades.

Figure 1:
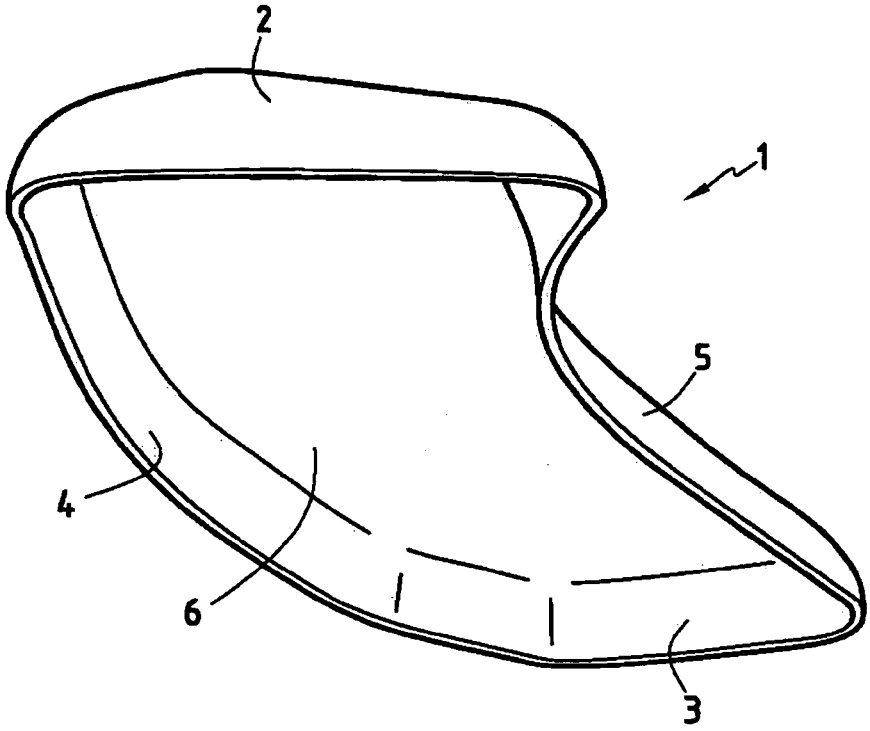
FIG.1 PRIOR ART
FIG. 1 is a view from below and in perspective of a sealing liner of the prior art.
Figure 2:
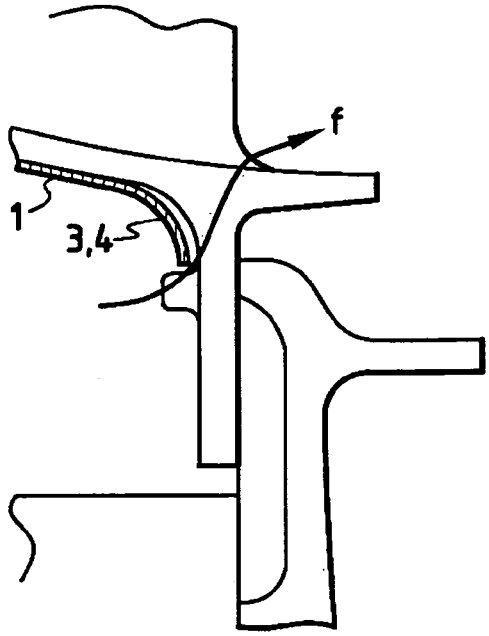
FIG.2 PRIOR ART
FIG. 2 is a side view in section of a liner edge and of a radial edge of a blade, of the prior art.

The upstream edge 12 presents two notches 16 and 17 which define between them an elastic zone 18 which, at rest, projects forwards from the upstream edge 2 of the prior art liner 1 shown in FIG. 1. That is, at rest, the elastic zone 18 lies outside the geometrical surface which would join together the ends 12*a* and 12*b* of the upstream edge 12 smoothly and continuously, which ends are situated beyond the notches 16 and 17, and connected to the longitudinal edges 14 and 15 respectively via convex surfaces.

Figure 5:
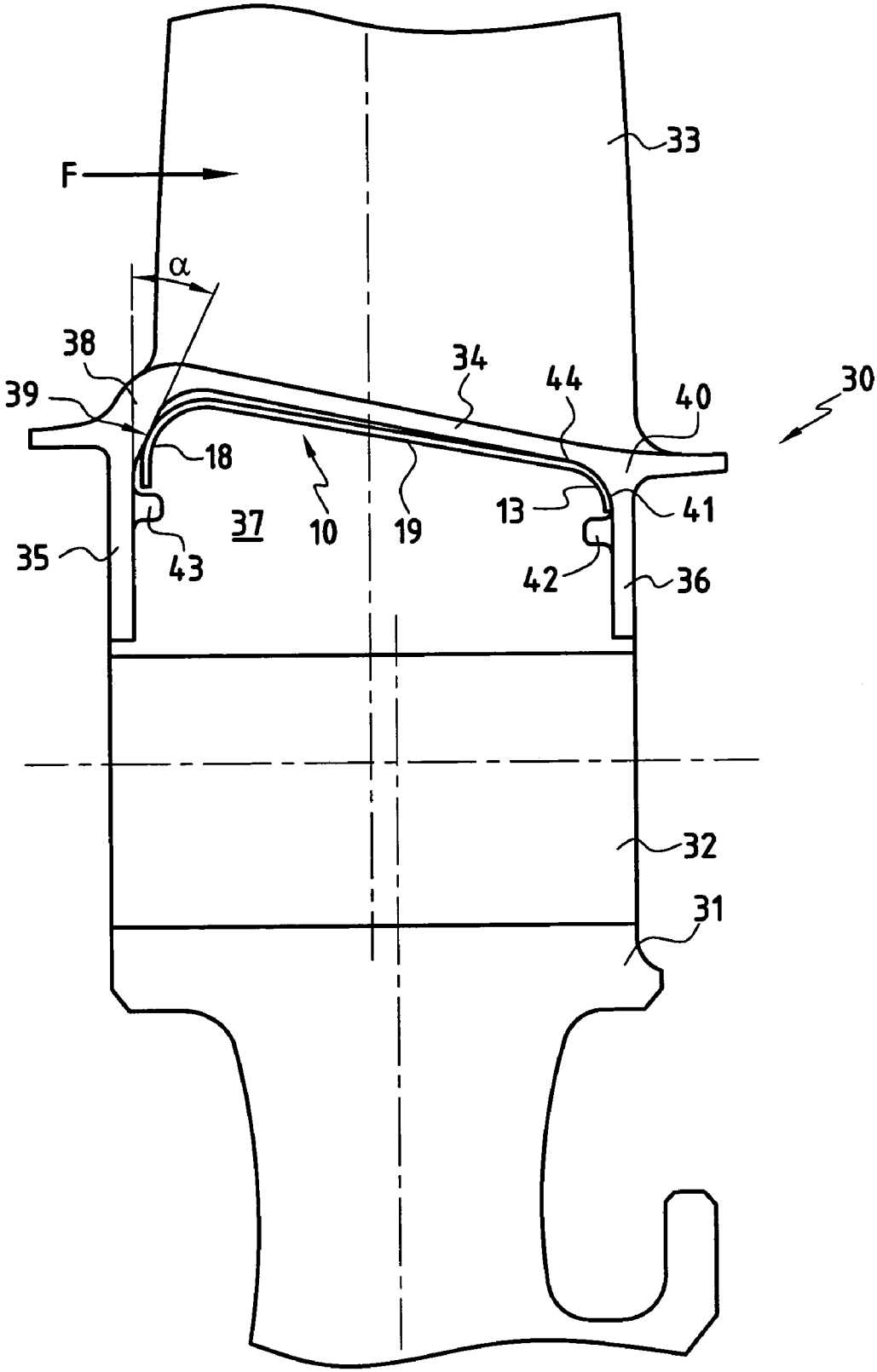
FIG. 5 is a section on a plane containing the axis of the blade-wheel, showing the disposition of the sealing liner of the invention in the under-platform cavity, after assembly and in the absence of centrifugal forces.
Figure 6:
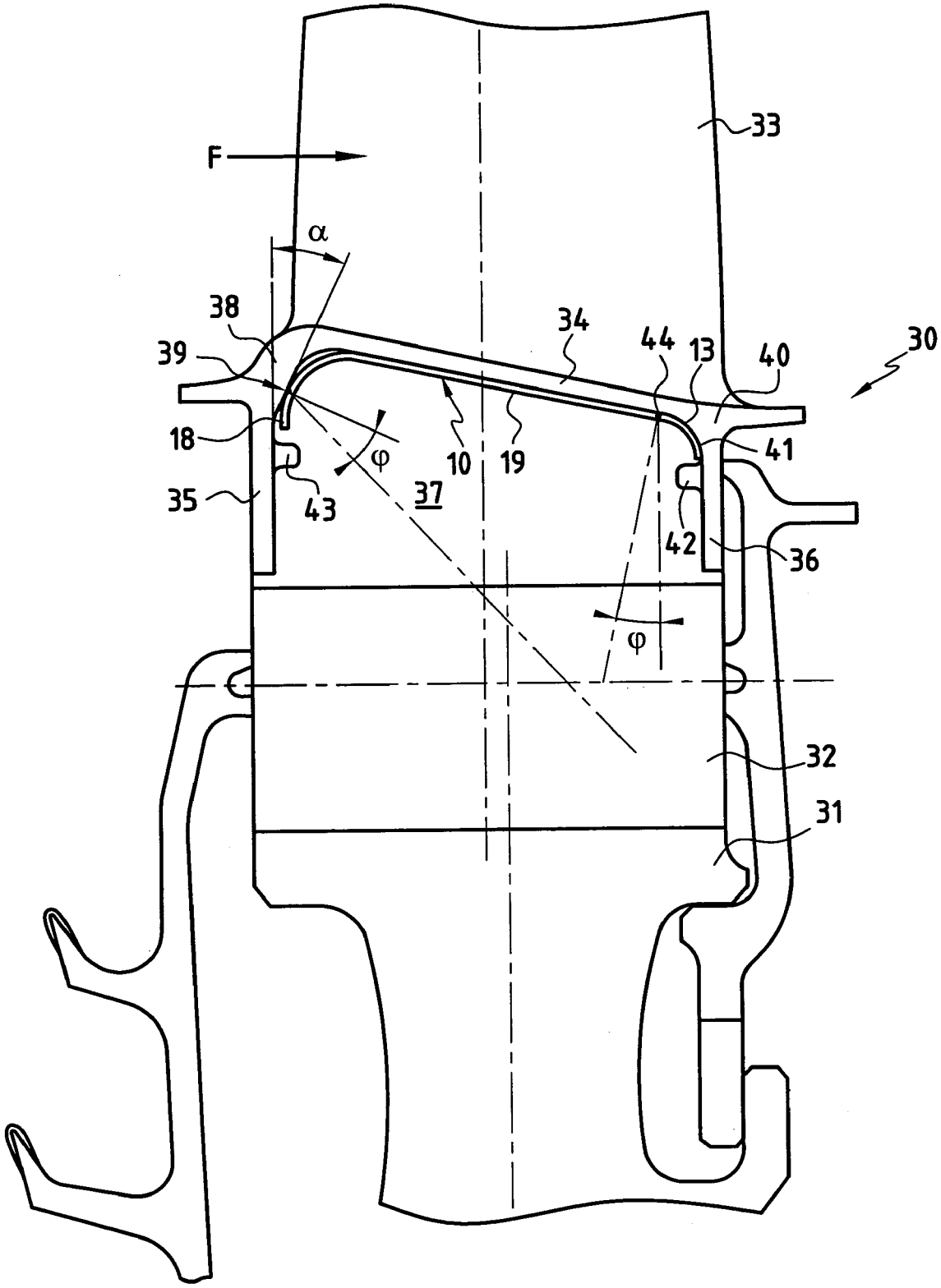
FIG. 6 is similar to FIG. 5 and shows the position of the sealing liner, when it is subjected to centrifugal forces as a result of the blade-wheel rotating.

FIGS. 5 and 6 show a blade-wheel 30 which comprises a disk 31 that presents a plurality of substantially axial slots 32 in its periphery, with each of said slots housing the root of a blade 33. Each blade 33 presents a platform 34 above its root, which platform defines the radially inner side of the stream of gas F going through the row of blades, the platform 34 being connected to an upstream radial wall 35 and to a downstream radial wall 36 which extend towards the periphery of the disk 31. Inter-blade cavities 37 are thus formed in the periphery of the disk 31 under the platforms 34. When the row of blades is observed axially in the direction of the stream of gas F, each blade 33 presents a platform portion on the right and a platform portion on the left. This same applies to the radial walls 35 and 36. Each under-platform cavity 37 is thus defined by right and left platform portions of two adjacent blades and by their right and left upstream and downstream lateral wall portions. By construction and because of assembly requirements, a gap or clearance separates the right hand portion from the left hand portion, which gap needs to be sealed by a sealing liner.

As shown in FIGS. 5 and 6, the connection 38 between the upstream radial wall 35 and the platform 34 presents beside the cavity 37, a surface 39 which makes an angle $\alpha$ with the radial plane that is perpendicular to the axis of rotation of the blade-wheel 30. The downstream radial wall 36 is connected to the platform 34 by a zone 40 that presents a curved surface 41, beside the cavity 37, said surface being complementary to the flaring of the downstream edge 13 of the liner 10. Moreover, the downstream radial wall 36 presents a protuberance 42 on its inside face, said protuberance serving as an abutment for the downstream shoulder of the liner 10. The upstream radial wall 35 also presents a protuberance 43 on its face situated beside the cavity 37.

The liner 10 is mounted in the cavity 37 in such a manner that its downstream edge 13 is positioned above the protuberance 42 and its elastic zone 18 is positioned above the protuberance 43. In this position, the elastic zone 18 of the liner 10 bears against the inclined surface 39.

The angle $\alpha$ of the inclined surface 39 is calculated as a function of the slope of the platform 34 relative to the axis of rotation of the wheel and as a function of the friction angle $\phi$ of the liner 10 against the inside surface of the platform 34, so that, in the absence of any centrifugal force, i.e. when the blade-wheel 30 is stationary, the elastic zone 18 slides radially inwards over the inclined surface 39.

In this position most of the surface of the top wall 19 of the liner is spaced apart from the bottom face of the platform 34, as can be seen in FIG. 5, the liner 10 tilting about an axis intersecting the plane of FIG. 5 at the point referenced 44, said axis being situated near the downstream flared edge 13. The protuberance 43 on the upstream radial wall 35 serves to prevent the elastic zone 18 from sliding too far, and to retain the liner 10 in the top zone of the cavity 37.

FIG. 6 shows the position of the liner 10 while the blade-wheel 30 is rotating. In this position, the liner 10 is subjected to centrifugal forces which tend to press it against the inside face of the platform 34. The elastic zone 18 is urged radially outwards and slides against the inclined wall 39.

The angle $\alpha$ is advantageously greater than the slope of the platform 34. When the elastic zone 18 moves outwards, through the fact that the liner 10 tilts about the pivot axis defined by the point referenced 44, the elastic force exerted by the elastic zone 18 increases and tends to move the liner 10 axially towards the downstream radial wall 36, thereby improving sealing in the connection zone 40. The axial movement of the liner 10 is limited by the protuberance 42 which serves as an abutment.

When the blade-wheel 30 comes to a stop, the liner 10 will return to the position shown in FIG. 5, as soon as the centrifugal forces are insufficient to prevent the elastic zone 18 from sliding over the inclined wall 39.

The invention claimed is:

1. A turbomachine blade-wheel comprising:

a disk presenting a plurality of substantially axial slots on its periphery;

a plurality of blades having roots retained in said slots, and which blades present platforms for defining a radially inner side of a stream of gas and upstream and downstream radial walls that extend from said platforms towards the periphery of said disk;

inter-blade cavities defined by said platforms and the periphery of said disk; and sealing devices configured to seal the inter-blade spaces, the sealing devices including liners having edges that flare radially inwards and that are disposed in said cavities against the walls of the platforms of two adjacent blades;

wherein each said liner presents an elastic zone on one of its upstream and downstream flared edges, and the radial walls adjacent to said edge are connected to the platforms by inside surfaces that are inclined relative to a radial plane, and against which edges said elastic zone bears, such that said elastic zone is configured to move radially inwards in an event of said wheel ceasing to rotate, and said elastic zone is configured to move radially outwards under action of centrifugal forces to urge said liner to move axially towards the radial walls distant from said elastic zone to improve sealing in said elastic zone.

2. A wheel according to claim 1, wherein the radial walls that are spaced apart from the elastic zones include abutments to limit axial movement of the liners under the action of centrifugal forces.

3. A wheel according to claim 1, wherein the lateral walls that are adjacent to the elastic zones include abutments to limit inward sliding of said elastic zones.

4. A wheel according to claim 1, wherein the elastic zones are circumferentially defined by two notches that are cut in the corresponding flared edges of the liners.

5. A wheel according to claim 1, wherein the elastic zone is provided on the upstream edge.

6. A wheel according to claim 5, wherein the wheel is a turbine blade-wheel.

7. A wheel according to claim 6, wherein an angle of the inclined surface is greater than the slope of the platform relative to an axis of rotation of the turbomachine.

8. A turbomachine comprising:

a blade-wheel including, a disk presenting a plurality of substantially axial slots on its periphery;

a plurality of blades having roots retained in said slots, and which blades present platforms for defining a radially inner side of a stream of gas and upstream and downstream radial walls that extend from said platforms towards the periphery of said disk;

inter-blade cavities defined by said platforms and the periphery of said disk; and sealing devices configured to seal the inter-blade spaces, the sealing devices including liners having edges that flare radially inwards and that are disposed in said cavities against the walls of the platforms of two adjacent blades;

wherein each said liner presents an elastic zone on one of its upstream and downstream flared edges, and the radial walls adjacent to said edge are connected to the platforms by inside surfaces that are inclined relative to a radial plane, and against which edges said elastic zone bears, such that said elastic zone is configured to move radially inwards in an event of said wheel ceasing to rotate, and said elastic zone is configured to move radially outwards under action of centrifugal forces to urge said liner to move axially towards the radial walls distant from said elastic zone to improve sealing in said elastic zone.

9. The turbomachine according to claim 8, wherein the radial walls that are spaced apart from the elastic zones include abutments to limit axial movement of the liners under the action of centrifugal forces.

10. The turbomachine according to claim 8, wherein the lateral walls that are adjacent to the elastic zones include abutments to limit inward sliding of said elastic zones.

11. The turbomachine according to claim 8, wherein the elastic zones are circumferentially defined by two notches that are cut in the corresponding flared edges of the liners.

12. The turbomachine according to claim 8, wherein the elastic zone is provided on the upstream edge.

13. The turbomachine according to claim 12, wherein the wheel is a turbine blade-wheel.

14. The turbomachine according to claim 13, wherein an angle of the inclined surface is greater than the slope of the platform relative to an axis of rotation of the turbomachine.

* * * * *